United States Patent [19]

Burdick et al.

[11] Patent Number: 4,565,114

[45] Date of Patent: Jan. 21, 1986

[54] CARTRIDGE STRIP MAGAZINE FOR POWDER-ACTUATED TOOLS

[75] Inventors: Bruce E. Burdick, Godfrey, Ill.; John A. Rodden, Florissant, Mo.; Robert G. Brown, Wood River; Rodney N. Barnard, Jerseyville, both of Ill.

[73] Assignee: Olin Corporation, Stamford, Conn.

[21] Appl. No.: 447,923

[22] Filed: Dec. 8, 1982

[51] Int. Cl.[4] ..... F42D 39/08

[52] U.S. Cl. ..... 89/35.01; 102/531; 102/515

[58] Field of Search ..... 89/35 R; 102/531

[56] References Cited

U.S. PATENT DOCUMENTS

| | | | |
|---|---|---|---|
| 3,318,245 | 5/1967 | Ferri et al. | 89/35 R |
| 3,625,153 | 12/1971 | Gawlick | 102/531 |
| 4,036,103 | 7/1977 | Gawlick et al. | 89/35 R |
| 4,056,062 | 11/1977 | Walser et al. | 89/35 R |
| 4,098,169 | 7/1978 | Gawlick et al. | 89/35 R |

*Primary Examiner*—Peter A. Nelson

*Attorney, Agent, or Firm*—Bruce E. Burdick

[57] ABSTRACT

A cartridge magazine for holding cartridges for feeding to the barrel of an explosion driven fastener setting tool comprises an elongated flat flexible strip or band preferably made of an inexpensive material such as plastic. The strip includes a plurality of stepped projections defining cartridge holding recesses arranged at equally spaced locations along the strip and lateral recesses for advancement. Each cartridge holding recess is defined by a stepped projection extending upwardly from the strip which on its exterior is stepped inwardly in a direction toward the tip of the cartridge. The angular taper of each of the outside walls of this portion on the cartridge magazine is slightly less than one cone angle of the cartridge chamber of a gun barrel with which it is to be employed, so that there will be more than one sealing point between the projections and the inner wall of the cartridge chamber.

3 Claims, 8 Drawing Figures

CARTRIDGE STRIP MAGAZINE FOR POWDER-ACTUATED TOOLS

BACKGROUND AND SUMMARY OF THE INVENTION

The present invention relates to cartridge strip magazines for holding propellant cartridges to be fed to repeating, powder-actuated fastener setting tools.

A cartridge magazine of one of the more widely used types conventional prior to the present invention is seen in U.S. Pat. No. 3,611,870, which describes a strip with conical projections with a cone angle greater than that of the chamber in which they are to be used. The present invention provides an alternative to and improved replacement for the prior art cartridge magazine band of U.S. Pat. No. 3,611,870.

Most explosion driven bolt setting tools customarily have a forwardly biased barrel axially slidable within a housing, the tool being operable for safety reasons only when the barrel muzzle is pushed against the target so as to push the barrel breech to the rear adjacent a firing pin. In such tools, the barrel breech customarily has a substantially coaxially arranged cartridge chamber which moves with the barrel in an axial direction as the barrel slides. Many of such tools have since the early 1960's had a conical cartridge chamber and since the mid 1960's have had a magazine feed channel extending substantially perpendicularly to the main axis of the tool for receiving a cartridge magazine and allowing the magazine to feed across the main axis of the tool. Tools with conical cartridge chambers are predominate at the present time and it is for use in such tools that the present invention is intended. The cartridges in such a tool must be arranged substantially parallel to the main axis of the tool once the cartridge magazine is put into the magazine feed channel. When the barrel is moved rearward the respective cartridge which extends coaxially to the cartridge chamber must be introduced into the cartridge chamber. The cartridge magazine used for such an application must be a relatively flat strip of plastic material which also projects from the strip so as to surround the lower walls of the cartridge and seal against a conical chamber. Cartridge magazine strips of the general type in which the cartridge remains held within the magazine strip before, during and after firing have been known since at least the first World War. Since about 1960 it has been customary to surround the cartridges with frustoconical plastic shrouds having a cone angle equal to or greater than that of a corresponding conical cartridge chamber. The obvious application of such magazines to repeating setting tools was made in the mid-to-late 1960's. Since conical plastic shrouded rounds and conical cartridge chambers were in wide use it was simplest that plastic conical shrouds be part of such strips. The adoption of such conical plastic shrouds (single or in strip) was further suggested by the fact that cartridges in resilient conical plastic shrouds were well known as a means of making the cartridge self-eject due to their resilience without need for mechanical ejectors in the tool, and eliminates the need to shake spent cartridges out of the chamber. Stripping of ammunition has been conventional since the advent of the machine gun and multiple fire setting tools have been known since the late 1950's. However, prior art conically shrouded multiple round magazines are known to have a tendency of misfire (fair to fire) or leak gas. A solution to these problems is needed.

The cartridge must fit tightly in the cartridge magazine so that the cartridge will not remain in the cartridge chamber when the tool is removed from the target and the barrel moves forward but rather will remain with the magazine and thus be removed from the cartridge chamber of the barrel.

This invention provides a new and useful cartridge magazine strip having non-conical stepped projections which define cartridge receiving recesses at fixed spaced locations along the length of the strip and which have an internal dimension small enough to cause the projections to pressure engage the exterior of a cartridge and to surround the cartridge adjacent the base thereof but to allow the top end of the cartridge to project outwardly therefrom, the cartridge holding projections having a stepped exterior surface which both facilitates a quick release from a conical inner wall surface of the cartridge chamber defined by the barrel of a fastener setting tool and provides multiple sealing points and a shock absorbtion cavity between the projections and barrel chamber.

In accordance with the invention there is provided a strip magazine designed as a disposable magazine for receiving and surrounding the walls of a cartridge. The magazine includes stepped projections on the front side of the strip. The base of the cartridge fits into the recess of the strip and its bottom end is preferably aligned flush with the back side of the strip. The cartridges are held in the recesses with a press-fit. The outside walls of the strip projections are stepped in decreasing external diameter toward the tip of the associated cartridge from the cartridge bottom. By making the projections which define the cartridge receiving recesses with the non-conical stepped configuration it is possible to use the magazine in connection with a setting gun having a barrel chamber which is conically formed yet still provide even aligned feeding of the cartridge into the conical barrel cartridge chamber. In addition, the steps of the projections abruptly reduce the outside diameter of the projections to both (a) give multiple high pressure sealing points with a shock absorbing cavity therebetween and (b) reduce the contact surface area between chamber wall and projection to help prevent self-locking of the cartridge or of the cartridge magazine itself within the conical cartridge chamber of the gun barrel. In this way jamming of the cartridge or strip in the cartridge chamber of the gun barrel is avoided yet it is ensured that the cartridge will both be sealed in the chamber during firing and remain in the magazine and be withdrawn from the gun after firing due to the feeding movement of the magazine.

Since power tool cartridges are conventionally rimmed, to achieve a tight fit of the cartridge in the cartridge magazine recesses it was previously felt sufficient if the cartridges are held by the magazine only in an area adjacent the rim. However, in order to positively avoid splitting ("bursting") of rimfire cartridge cases, particularly with conical cartridge chambers, it is necessary that the cartridge strip is formed to embrace the cartridge approximately up to the cartridge crimp region in which the tubular projection forming the cartridge recess is of a minimum wall thickness so that the gap from the unsupported projecting portion of the cartridge case to the wall of the cartridge chamber defined by the gun barrel will be a minimum. In the preferred embodiment of the invention the cartridge magazine embraces the cartridge for slightly more than ⅔ of its height, i.e., up the cartridge wall to the bottom of the crimped forward end of the cartridge. The magazine also engages the rimmed bottom or base of the cartridge around its periphery or rim. The magazine is constructed so that the parts thereof which are exposed to high pressures and temperatures during the explosion and the burning powder gases will not melt or flow and lose their sealing ability in the chamber because gas flow in a direction opposite to the driving direction along with any backward blow off of the propellant gases must be prevented or the strip will be burnt apart ("shot off") between the projections. The construction is such that the stepped cartridge magazine projections are supported by the conical chamber when the tool barrel is in the firing position, the support being both at the location of the stepped projections and the strip between adjacent projections.

The cone angle of any conically tapered parts of the stepped cartridge magazine projections is made slightly less (skinnier cone) than the cone angles of the conical cartridge chamber of the barrel of the receiving gun so that the forward or outer edge of the step forms a sealing ring. Alternately, if the projection is of a non-conical arcuate shaped exterior, the sealing point would be toward the middle of the arc, specifically at the point where a tangent to the arc would be parallel to the conical inner surface of the chamber. The cartridge chamber wall and these sealing rings of the cartridge magazine must come in contact with each other preferably both adjacent the part of the cartridge chamber which faces the cartridge magazine and at or near the projection tip so that an increased compressive stress on the plastic is ensured in these contact region when the gun is pressed against the target material and to provide a shock absorption cavity between the sealing rings. These sealing rings prevent the cartridge contained in the cartridge chamber from shifting forward axially and the necessary ignition energy can thus be kept very low. Under the action of the firing pin the smaller cone angle (i.e., steepness) of the walls of the steps relative to the chamber walls causes the leading edge to serve as the sealing point rather than the rear of the projection as was previously thought necessary. Using the leading edge as the sealing point gives the seal greater strength since the step, which is highly compressed by the chamber walls in the firing position, is most difficult to further compress to allow firing gas to pass; whereas if the trailing edge is the sealing point bending might let gas to pass. Also, the steepness of each of the steps is a cone angle less than the cone angle chamber and this makes the steps stronger since the steepness results in the forces on the step being directed more along the axis of the projection than would be the case if the steps were less steep. Furthermore, the shock absorption cavity will be at a higher gas pressure than the gas pressure in the portion of the chamber forward of the projection due to the combined effect of the barrel precompressing the projection (and hence the cavity) and the compression of the cavity due to case expansion. This cavity pressure also encourages self-ejection of the strip from the chamber.

Accordingly, it is an object of the invention to provide an improved magazine construction which includes a base member such as a belt or band having a plurality of steeply stepped tubular projections forming cartridge receiving recesses of a dimension such that the magazine will embrace each cartridge adjacent its lower portion and hold it with a press-fit, the outer wall of the tubular projections being steeply stepped for improved sealing and easy release from a conical cartridge chamber of a gun barrel. The steps may alternatively be arcuate.

A further object of the invention is to provide a cartridge magazine which is simple in design, rugged in construction, and economical to manufacture.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
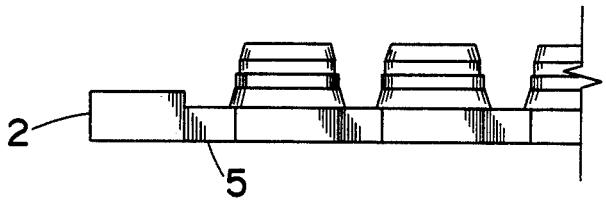
FIG. 1 is a side elevational view of a magazine constructed in accordance with the invention.

Referring to the drawing in particular, the invention embodied therein comprises a cartridge magazine generally designated 1 which comprises an elongated narrow band or strip 2 having cutouts or notches 5 on each side arranged at evenly spaced locations along the length thereof. The cutouts or notches 5 are provided for engagement with an advancing mechanism (not shown) of a gun setting device which is operative during firing of a cartridge to advance or index the magazine to present one cartridge after the other into alignment with the cartridge chamber of the gun barrel.

Figure 2:
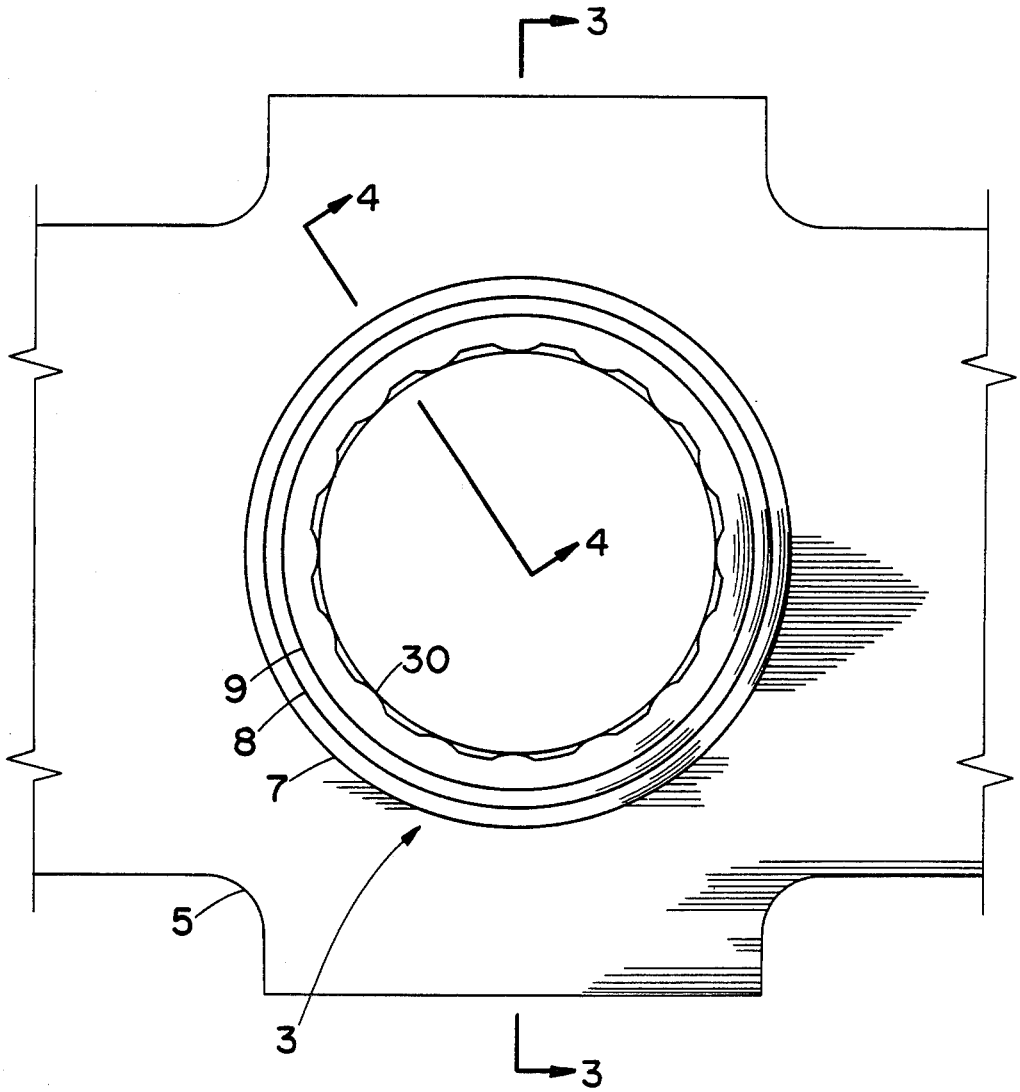
FIG. 2 is a partial top plan view of the magazine indicated in FIG. 1.
Figure 8:
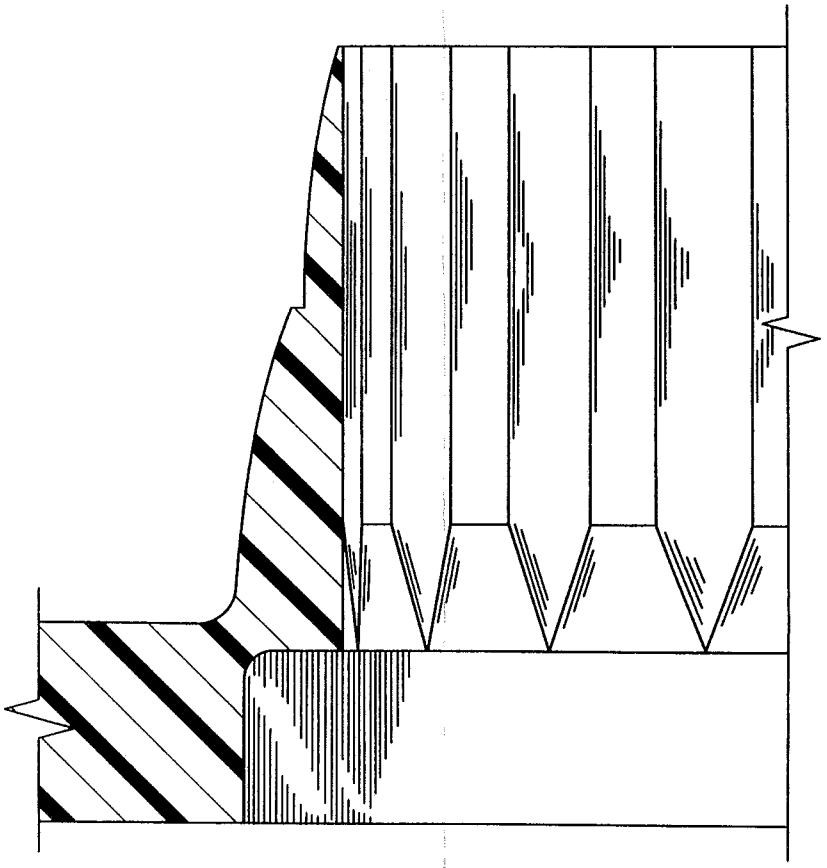
FIG. 8 is an enlarged partial longitudinal section taken on the lines 8—8 of FIG. 6 and indicating the preferred taper of the magazine in relation to the cartridge chamber of the gun barrel in the preferred construction.
Figure 7:
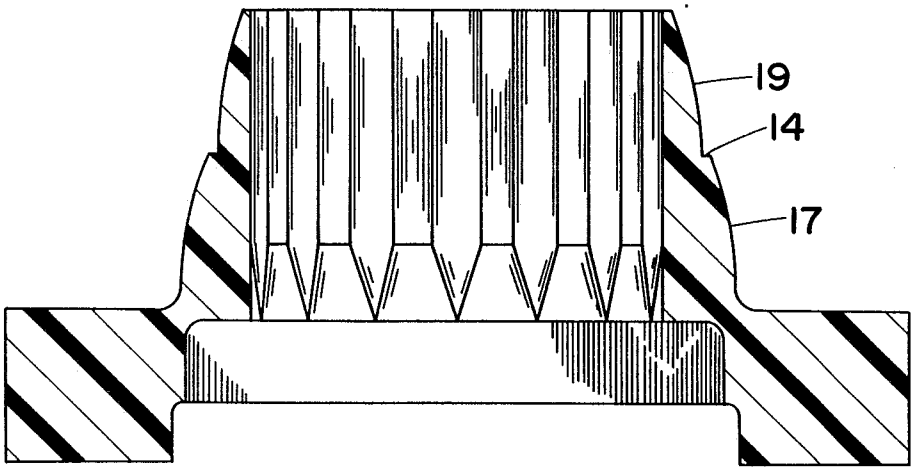
FIG. 7 is an enlarged section taken on the lines 7—7 of FIG. 6.

In accordance with the invention a plurality of stepped tubular projections 3 are defined at equally spaced locations along the length of the band 2 on one face thereof. The projections 3 define cartridge receiving recesses 4 having a dimension adjacent the top thereof, as seen from FIG. 2, which is less than the external dimension of a cartridge 10 (see FIGS. 4 and 8) at its cylindrical base portion immediately above a widened base 11 thereof.

In view of the provision of the cutouts 5 on each side of the band 2 the magazine band 2 may be inserted into a gun chamber from either of its ends. The notches 5 will be aligned on each side with an indexing mechanism which engages notches 5.

The invention concerns the construction of the projections 3 with an exterior wall which is not conically tapered as with prior strips, but is instead stepped so that it may be easily aligned into a conically tapered (unstepped) wall of a cartridge chamber 21 formed at the rear end of a barrel 20 of a gun setting device (not fully shown). The steps 7, 8 and 9 seal the chamber 21 at multiple points and together with the wall of a cartridge chamber of conical shape define two shock absorption cavities 11 and 12 therebetween. The gun setting device is of a type which is used for anchoring elements such as anchoring bolts, nails and the like into a hard receiving material such as concrete. The interior of the tubular projections 3 are preferably longitudinally ribbed with shallow ribs 30 conically tapered or formed to a smaller dimension at the top or open end so that they can be pulled out of the mold in which they are made and so that they will tightly engage against the wall of the cartridge, and the cartridge will be press-fitted or frictionally held within the ribs 30 of the recess 4. These ribs are shallow so that they will disappear under the compression of the press-fit with the cartridge, to provide sealing completely around the cartridge case, yet also give an increased cartridge gripping ability to the strip over the inferior gripping of certain prior art strips.

Each of the tubular projections 3 have a widened base. The sides bounding the cutouts 5 are reinforced to facilitate an even feeding of the magazine by mechanism which engages in the recesses behind the reinforced areas. The magazine material used is an inexpensive plastic as with conventional shrouded rounds.

Figure 4:
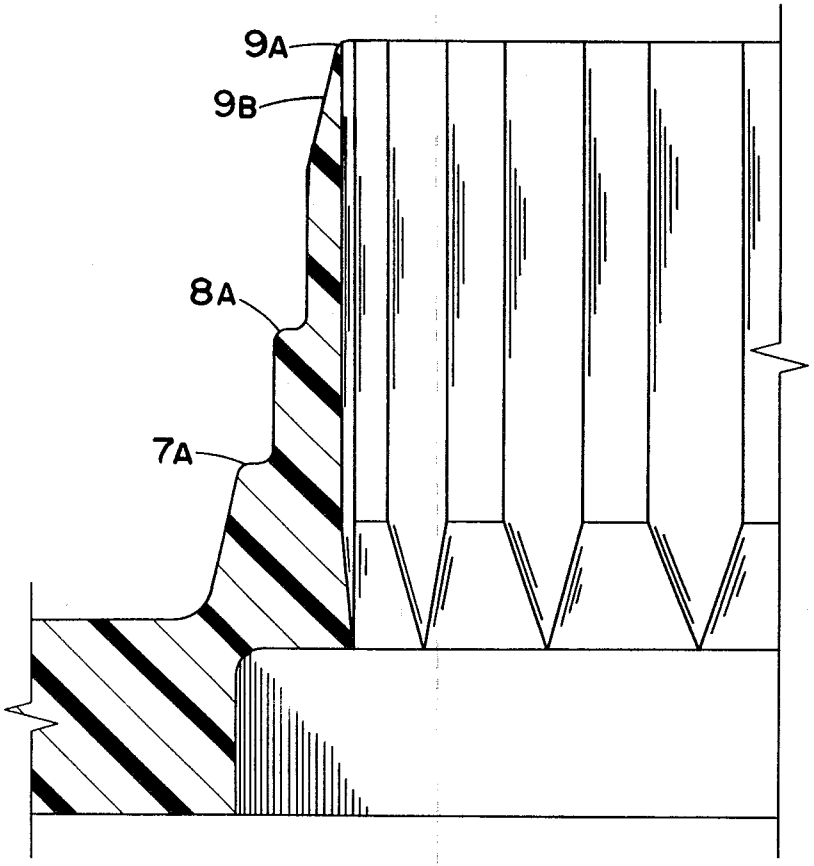
FIG. 4 is an enlarged partial longitudinal section taken on the lines 4—4 of FIG. 2 and indicating the preferred taper of the magazine in relation to the cartridge chamber of the gun barrel in the preferred construction.
Figure 3:
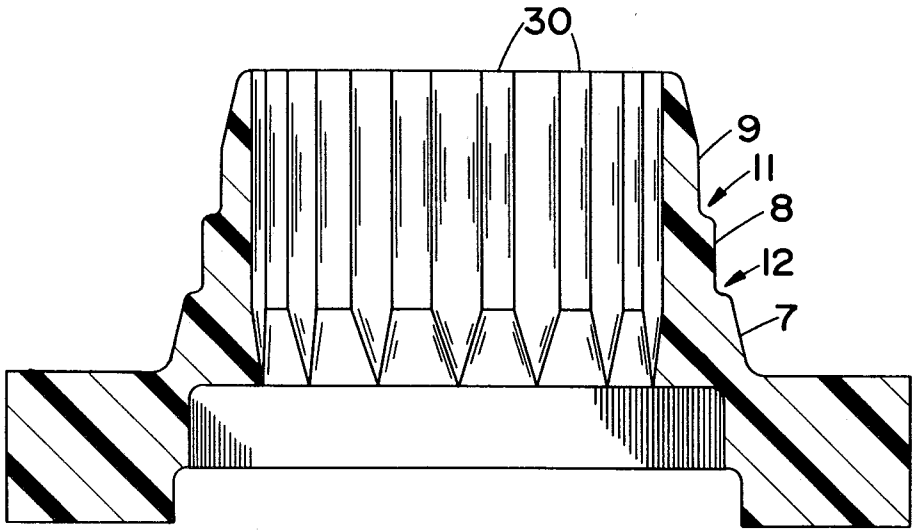
FIG. 3 is an enlarged section taken on the lines 3—3 of FIG. 2.
Figure 5:
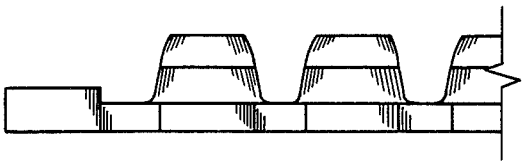
FIG. 5 is a side elevational view of a second magazine constructed in accordance with the invention.
Figure 6:
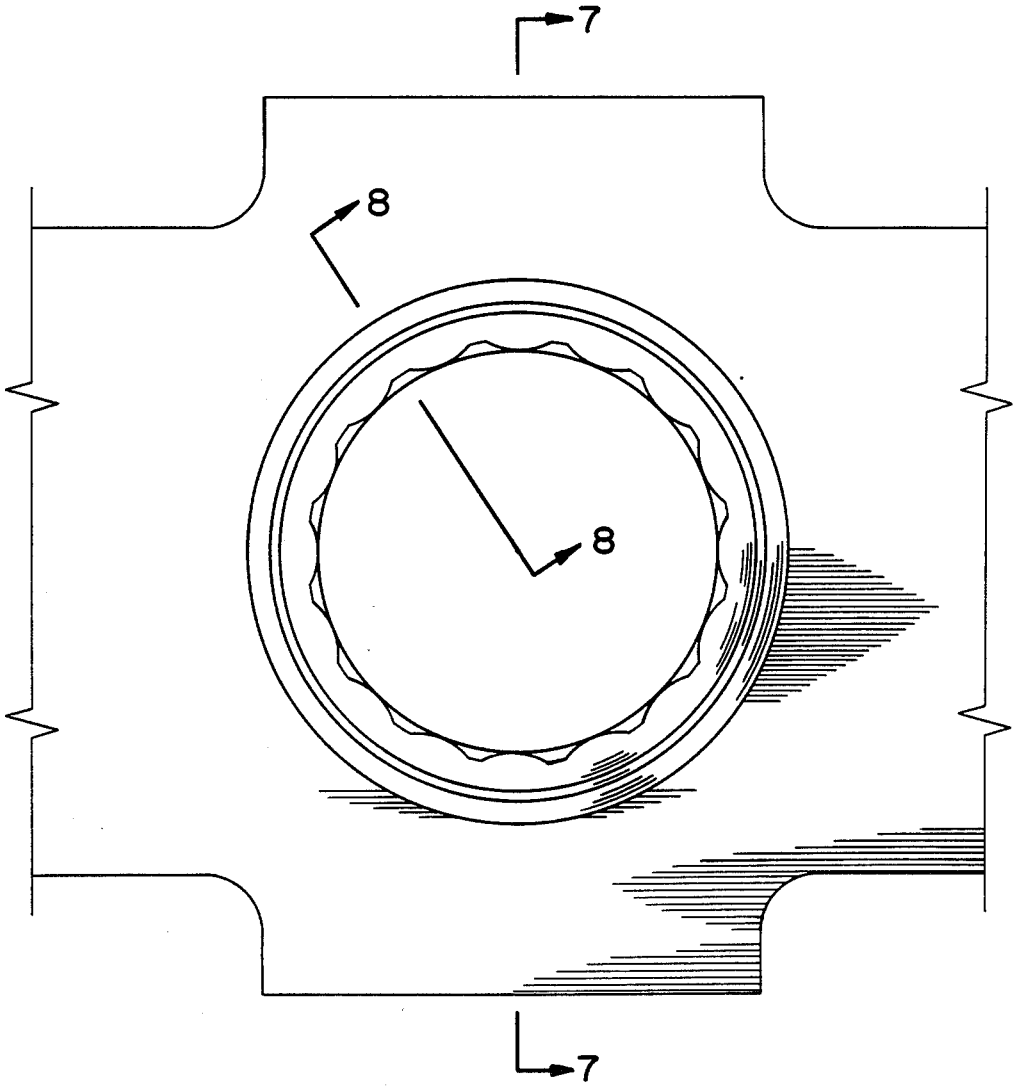
FIG. 6 is a partial top plan view of the magazine indicated in FIG. 5.

As indicated in FIG. 4, the magazine 1 is shown arranged at the rear end of the barrel 20 of the setting gun. The cartridge 10 which is contained in the magazine is shown in phantom located centrally within the barrel of the gun. An end face 21*a* of the barrel is engaged against a base portion 2*a* of the band and a conical face defining a cartridge chamber 21 is engaged against the exterior stepped face of the tubular projection 3.

The cartridge chamber 21 must have a greater cone angle than each of the steps 7, 8 and 9 of the cartridge magazine. The cone angle of the stepped part 3 of the magazine 1 is slightly less than the cone angle of the conical cartridge chamber 21. This assures sealing at the top end of the projection to decrease the exposure of the exterior of the projection 3 to hot firing gases. In this construction the cartridge chamber wall and the stepped part 3 of the cartridge magazine come in contact with each other particularly in the part of the cartridge chamber 21 facing away from the cartridge magazine 1, so that an increased compressive stress on the plastic material of the cartridge magazing 1 will be ensured in this contact region and so that cavities 11 and 12 will be compressed to serve their intended sealing and ejection aiding function. Under the action of the firing pin the cartridge arranged in the cartridge chamber 21 will not yield axially, thus the necessary ignition energy can be kept very low in contrast to prior art strips where the projections were conical with a cone angle greater (rather than smaller, as here) than the cone angle of the chamber.

The step structure of the projections 3 and the cartridge chamber 21 is so designed that a self locking of the cartridge in the cartridge chamber would be prevented by both axial compressive forces and shock absorption cavity pressures tending to eject the projections, and this is true even more so after its ignition. The cartridge will be introduced into the cartridge chamber 21 by the rearward movement of the barrel 20. After ignition the generated gases expand forwardly from the chamber into the barrel and against a driving piston (not shown) to move it and an associated piston ram rapidly forward forcibly set a fastener into its target.

After ignition the chamber is returned by a spring to its forward position off of the cartridge and magazine. Therefore, a special means for ejecting the cartridge is not necessary. In addition, the gun need not be provided with an extra opening for ejecting the cartridge shell because it will remain with the magazine and will be moved by a further indexing of the magazine upwardly and outwardly through an opening in the gun provided for the magazine passage.

It will be seen that addition of steps 7, 8 and 9 to projection 3 results in leading edges or sealing rings 7*a*, 8*a* and 9*a*. *These leading edges 7a,* 8*a* and 9*a* contact the chamber wall before the remained of the walls 7*b*, 8*b* and 9*b* of steps 7, 8 and 9. Edges 7*a*, 8*a* and 9*a* thus have much greater compressive forces upon them causing excellent sealing in contrast to the much lower leading edge compressive forces in prior art strips. Gas leaks have been virtually eliminated by this improvement.

Referring next to FIGS. 5–8, a more preferred second strip embodiment is strip 12, shown, wherein there are two arcuate sealing steps 17 and 19 instead of the three steps 7, 8 and 9 of the embodiment of FIGS. 1–4. Strip 12 thus has only one shock absorption cavity 14, which lies between steps 17 and 19 and serves as a high pressure gas space to help both sealing before and during firing and to assist in ejection of the strip from the cartridge cahmber with which it is to be used.

With the above disclosure in mind, it is noted that non-conical strip projections (shrouds) have been described which seal and eject in a superior fashion to those wide conical projections for skinny conical chambers which have been previously thought necessary. "Conical" is used herein in the same sense as in U.S. Pat. No. 3,611,870 to mean a geometric figure created by an infinite number of straight lines connecting a circle to a point on the axis line passing through the center of the circle, whether or not the cone has actually been truncated to make a "frustoconical" structure.

What is claimed is:

1. A plastic cartridge magazine particularly for the use with an explosive charge driven setting tool having a cartridge chamber wall defining a conical cartridge chamber at the barrel breech of the tool, said magazine comprising a plastic magazine band having at least one opening therethrough for receiving the base of a cartridge, an externally stepped tubular projection on one side of said band extending around the opening and defining with the opening a cartridge receiving chamber extending through the band to the opposite side thereof, and defining both a plurality of spaced plastic sealing rings for sealing contact with said chamber and a shock absorption cavity between said plurality of rings.

2. The magazine of claim 1 wherein said steps are arcuate and said cavity is of a three sided cross sectional shape with two concave sides defined by the arcuate steps on either side of said cavity and one conical side defined by the conical chamber wall.

3. The magazine of claim 1 wherein the opening is ribbed to provide extra gripping force upon a cartridge when a cartridge is inserted into said opening.

* * * * *